US006402398B1

(12) United States Patent
Szajewski et al.

(10) Patent No.: US 6,402,398 B1
(45) Date of Patent: Jun. 11, 2002

(54) APPARATUS AND METHOD FOR PROCESSING A PHOTOGRAPHIC PRODUCT

(75) Inventors: Richard P. Szajewski, Rochester; Wanda K. Swartz, Albion, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/579,183

(22) Filed: May 25, 2000

(51) Int. Cl.[7] ..... G03D 5/00
(52) U.S. Cl. ..... 396/604; 396/626; 430/405
(58) Field of Search ..... 396/604, 606, 396/612; 403/405, 449, 485

(56) References Cited

U.S. PATENT DOCUMENTS

| | | | | |
|---|---|---|---|---|
| 4,155,637 A | * | 5/1979 | Witte et al. | 396/606 |
| 5,118,591 A | | 6/1992 | Koboshi et al. | 430/351 |
| 5,443,943 A | | 8/1995 | Szajewski et al. | 430/393 |
| 5,744,288 A | | 4/1998 | Buchanan et al. | 430/383 |
| 5,752,121 A | * | 5/1998 | Earle et al. | 396/606 |
| 5,789,144 A | | 8/1998 | Thomas | 430/449 |
| 5,834,169 A | | 11/1998 | Thomas | 430/405 |
| 5,840,470 A | | 11/1998 | Bohan et al. | 430/359 |
| 5,942,380 A | | 8/1999 | Thomas | 430/484 |

* cited by examiner

*Primary Examiner*—D Rutledge
(74) *Attorney, Agent, or Firm*—David A. Novais

(57) ABSTRACT

A photographic material processing apparatus and method provides for a homogeneous application of processing solution which leads to homogeneous development. The apparatus utilizes a spreader member in the form of, for example, a spreader bar that applies a limited quantity of developer solution to photographic material such as imagewise exposed film. A pressure member in the form of, for example, a weighted roller or spring-loaded roller acts a squeegee roller and improves contact of the film with a support and/or a heating source. A roller arrangement which includes at least the spreader member and pressure member is configured to enable multiple contacts of the spreader member and pressure member with the photographic material to aid in the agitation of the applied developer solution. In a further embodiment, an additional member in the form of, for example, a mixer member can be utilized to further agitate the applied solution.

31 Claims, 2 Drawing Sheets

APPARATUS AND METHOD FOR PROCESSING A PHOTOGRAPHIC PRODUCT

FIELD OF THE INVENTION

The present invention relates to an apparatus and method for processing a photographic product or material, such as photosensitive film, that promotes a homogeneous development of the photosensitive film.

BACKGROUND OF THE INVENTION

The processing of photographic material or products which are not immersed in a tank filled with an activator usually occurs through the application of a thin layer of developer solution, such as a development activator, to a surface of an exposed photographic product. The development activator is usually applied in a thin layer to enable an aqueous solution to be applied uniformly on a support. Examples of development activator solutions are disclosed in U.S. Pat. No. 5,789,144.

Conventionally, a solution spreading apparatus such as disclosed in the above-mentioned U.S. Pat. No. 5,789,144, as well as U.S. Patent Nos. 5,834,169 and 5,942,380 is utilized to apply a developing solution onto the surface of the photographic product. For purposes of development, it is preferred that the developer solution be applied in a controlled and limited manner. Conventional solution spreading apparatuses as described above have a drawback in that they make it difficult to provide for a homogeneous spreading of the developing solution. This leads to an inhomogeneous or uneven development which adversely affects the final photographic product.

SUMMARY OF THE INVENTION

The present invention provides for a novel apparatus and method for developing photographic material and/or applying developing solution onto a surface of the photographic material in a manner in which the developing solution is applied in a homogeneous layer onto the surface of a photographic material. The apparatus includes a spreader member in the form of, for example, a spreader bar that applies a limited quantity of developer solution onto a photographic material, such as an imagewise exposed film stock. The apparatus further includes a pressure roller which can be, for example, a weighted roller or a spring-loaded roller which applies pressure onto the photographic material to enhance development.

As a further option, the apparatus could include a heating source that is adapted to heat the photographic material to enhance development.

In a further feature of the present invention, the spreader member and pressure roller can be configured in a manner that enables multiple contact of the spreader member and pressure roller with the photographic material. This enhances the agitation of the developer solution applied to the surface of the photographic material.

In a further feature of the present invention, a further roller member in the form of, for example, a mixer member can be associated with the spreader member and pressure roller. This enhances the agitation of the developer solution on the photographic material as the mixer member, pressure roller and spreader member are drawn past the photographic material.

The present invention provides for an apparatus for processing photographic material which comprises a spreader member that is adapted to apply a solution onto a photographic material and control a thickness of the applied solution; and a pressure roller operationally connected to and spaced from the spreader member for pressing down on the applied solution and providing for a substantially homogeneous layer of the applied solution on the photographic material.

The present invention further provides for a method of processing photographic material which comprises the steps of delivering a solution onto a surface of a spreader member; applying the delivered solution through the spreader member onto a surface of a photographic material; controlling a thickness of the applied solution on the photographic material by use of the spreader member; and pressing the applied solution on the photographic material by use of a pressing member, so as to provide for a substantially homogeneous layer of the solution on the photographic material.

The present invention further relates to an apparatus for processing photographic material which comprises a spreader member adapted to apply a solution onto a photographic material and control a thickness of the applied solution; and a mixer member operationally associated with the spreader member.

The present invention further relates to a method of processing photographic material, which comprises the steps of delivering a solution onto a surface of a spreader member; applying the delivered solution through the spreader member onto a surface of a photographic material; controlling a thickness of the applied solution on the photographic material by use of the spreader member; and agitating the applied solution by use of a mixer member.

DETAILED DESCRIPTION OF THE INVENTION

Figure 1:
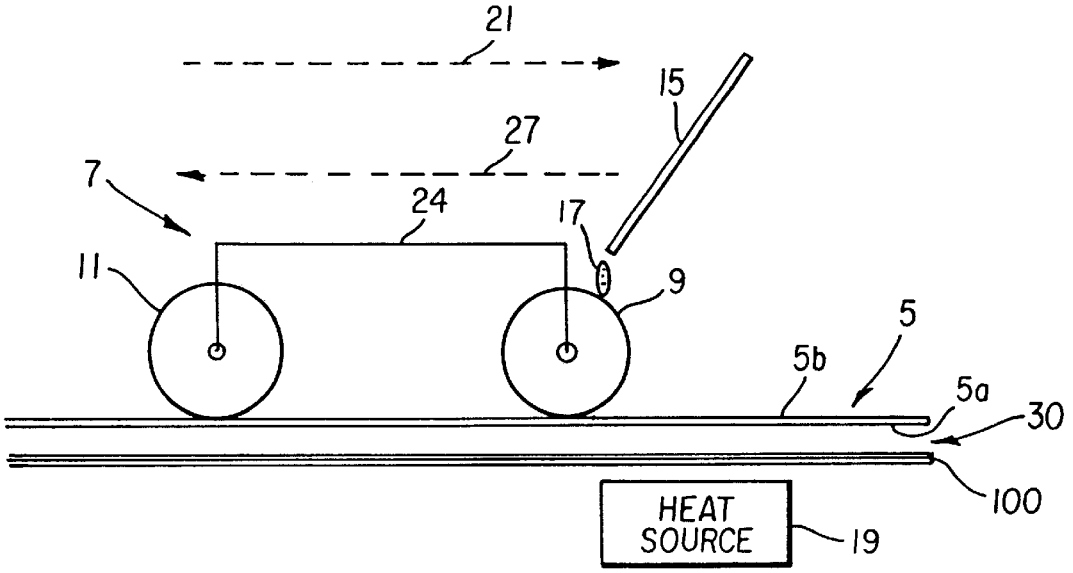
FIG. 1 is a side view of an overall apparatus including a spreader member and pressure roller in accordance with a first embodiment of the present invention.

Referring now to the drawings, wherein like reference numerals designate identical or corresponding parts throughout the several views, FIG. 1 is a side view of an apparatus for developing photographic material according to a first embodiment of the present invention. As illustrated in FIG. 1, a photographic material 5 which can be, for example, exposed photosensitive film is positioned on a support 100 relative to a roller arrangement 7. For purposes of the present invention, it is noted that as a first option, photographic material 5 can be conveyed under roller arrangement 7 which would be fixed to prevent axial movement, or roller arrangement 7 can be axially moved over photographic material 5 which would be fixed to prevent axial movement.

Figure 4:
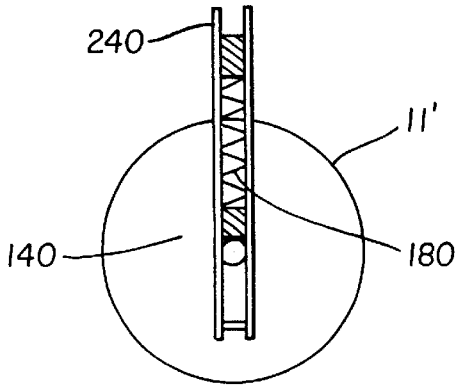
FIG. 4 is an example of a spring loaded roller which can be used in the present invention.

Roller arrangement 7 includes a spreader member 9 which can be, for example, a known wire-bar applicator. Spreader member 9 is mechanically connected to a pressure roller 11 by way of, for example, a frame 24. Pressure roller 11 can be a weighted roller, or, as a further option can be a spring loaded roller 11' as shown in FIG. 4. As an example, as shown in FIG. 4 spring loaded roller 11' could basically comprise a rotatably mounted roller 140 having a tube 240. Tube 240 would include a spring 180 which urges roller 140 in a downward direction. The embodiment of FIG. 1 further illustrates a solution delivery assembly 15, such as a tubing, for the application of developer solution 17 onto a surface of spreader member 9. Any known processing solution, silver developing or color forming developing solution can be employed. Useful silver developing solution formulations are disclosed in above-mentioned U.S. Pat. Nos. 5,789,144; 5,834,169 and 5,942,380. Useful color forming developing solution formulations are disclosed in U.S. Pat. Nos. 5,118, 591; 5,443,943; 5,744,288 and 5,840,470. Although a tubing is illustrated in FIG. 1, the present invention is not limited thereto and any type of apparatus such as a trough or pipe can be utilized to apply developer solution 17 onto the surface of spreader member 9.

In a further feature of the embodiment of FIG. 1, a heating source 19 which can be, for example, a ceramic block or grid is integrated into or provided below support 100 and serves to promote uniform heating of photographic material 5 on support 100. It is noted that any other known method of conveniently heating support 100 and photosensitive material 5 can be usefully employed.

During use of the apparatus illustrated in FIG. 1, photographic material 5, such as exposed film, is placed on support 100, and roller arrangement 7 including spreader member 9 and pressure roller 11 are conveyed over photographic material 5 in the direction illustrated by arrow 21. As a further option, roller arrangement 7 can be axially fixed and photographic material 5 can be conveyed under roller arrangement 7 in a direction opposite to direction 21.

As roller arrangement 7 is conveyed over photographic material 5 r a photographic material 5 is conveyed under roller arrangement 7, developer solution 17 is applied via solution delivery assembly 15 onto a surface of spreader member 9. Spreader member 9 applies developer solution 17 onto a top surface 5*b* of photographic material 5 in a controlled manner. For this purpose, spreader member 9 can be a known wire-bar applicator in which a wire is wrapped around a bar in a helical fashion. This arrangement permit a user to control the thickness of the applied solution bead.

Using the conveyance of roller arrangement 7 over photographic material 5 as an example, pressure roller 11 follows spreader member 9 as roller arrangement 7 proceeds along direction 21, and acts as a squeegee-type roller. More specifically, pressure member 11 presses the applied solution onto the surface of photographic material 5, and further presses photographic material 5 having the solution pressed thereon towards heating source 19 which helps advance development. As also illustrated in FIG. 1, pressure roller 11 is a fixed distance from spreader member 9, and can be mechanically connected to spreader member 9 by for example, a shaft, a bar, or any other connection means schematically illustrated by frame 24 in FIG. 1.

Therefore, with the apparatus illustrated in FIG. 1, the developer solution is delivered by way of solution delivery assembly 15 onto spreader member 9, and applied onto surface 5*b* of photographic material 5 by way of spreader member 9, which is in the form of, for example, a wire-wrapped spreader bar. This permits an even delivery of temperature controlled developer solution through solution delivery assembly 15 from a reservoir. The reservoir can be directly connected to solution delivery assembly 15 and the supply of developer solution can be controlled by a pump.

Pressure roller 11 which can be a weighted roller or a spring loaded roller follows spreader member 9 at a fixed distance during the first application pass in direction 21. This ensures good contact of pressure roller 11 with photographic material 5 and aids in pressing photographic material 5 against support 100 in the event a heat source 19 is used.

In a further feature of the present invention, roller arrangement 7 can be subsequently passed over photographic material 5 a second time in a second direction 27 illustrated by the arrow in FIG. 1. Direction 27 is opposite to the first direction 21. When passing the roller arrangement 7 in second direction 27, the supply of developer solution 17 through delivery assembly 15 is terminated. During passing of roller arrangement 17 in direction 27, spreader member 9 essentially acts as a mixing member to agitate the supplied developer solution on photographic material 5 during the second pass. This serves to enhance the homogeneous spread of critical material such as the developer solution. As an alternative, when roller arrangement 7 is axially fixed and photographic material 5 is being conveyed, during the second pass photographic material 5 would be conveyed under fixed roller arrangement 7 in a direction opposite to direction 27.

Figure 3A:
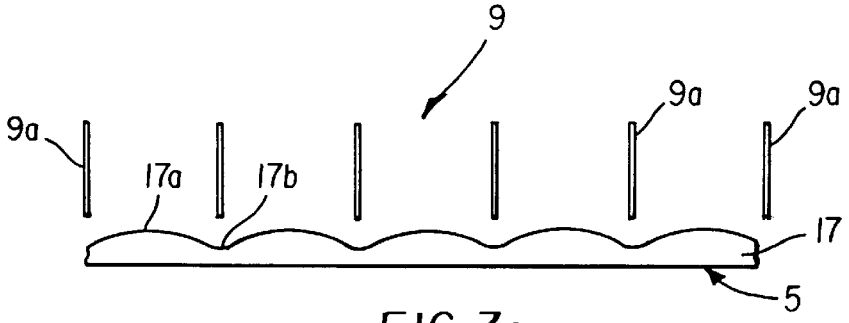
FIGS. 3*a*–3*c* schematically illustrate the treatment of the solution on the surface of the photographic material in accordance with the apparatus as illustrated in FIG. 1 or FIG. 2.
Figure 3B:
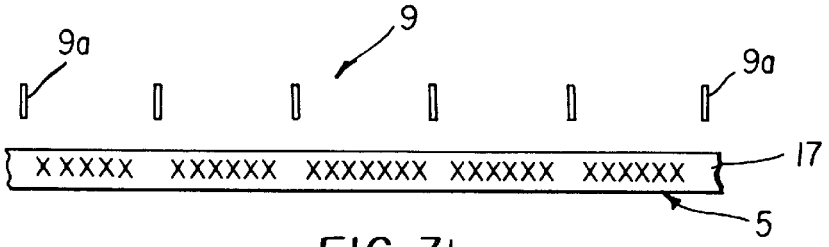
Figure 3C:
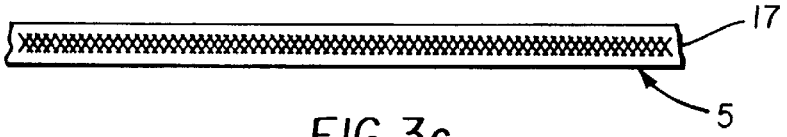

A schematic illustration of what occurs when applying, controlling and agitating the developer solution on the surface of photographic material 5 is illustrated in FIGS. 3(*a*)–3(*c*). FIG. 3(*a*) schematically illustrates a partial view of spreader member 9 having wires 9*a*. As illustrated in FIG. 3(*a*), the process of applying developer solution by way of spreader member 9 in the form of a wire bar roller results in depositing more solution (17*a*) between wires 9*a* and less solution (17*b*) under wires 9*a*. The conveyance of pressure roller 11 over the applied solution serves to uniformize the thickness of the solution and also provide for a homogeneous solution as shown in FIG. 3(*b*). However, as the solution is applied and thereafter pressed by pressure roller 11, the majority of the elements or components of developer solution 17 will tend to remain within the areas defined between wire rollers 9*a* as illustrated by the "x's" in FIG. 3(*b*). During the second pass, wires 9*a* of spreader member 9 agitates and/or mixes the elements or components of developer solution 17 so as to enhance a mixture of the components and therefore advance development as illustrated by the overlap "x's" in FIG. 3(*c*).

In a further feature of the present invention as illustrated in FIG. 1, a backside or lower surface 5*a* of photographic material 5 can be pre-wet with solution 30. This improves the thermal contact between photographic material 5 and support 100. Solution 30 could be the same as developer solution 17 or a different solution. Further, in the case of photosensitive film, pre-wetting of the film on the emulsion side aids in the spreading of applied solution 17. Also, the addition of surfactants such as Triton-200 and Olin 10-G to the applied developer solution 17 aids in the spreading of the solution.

Figure 2:
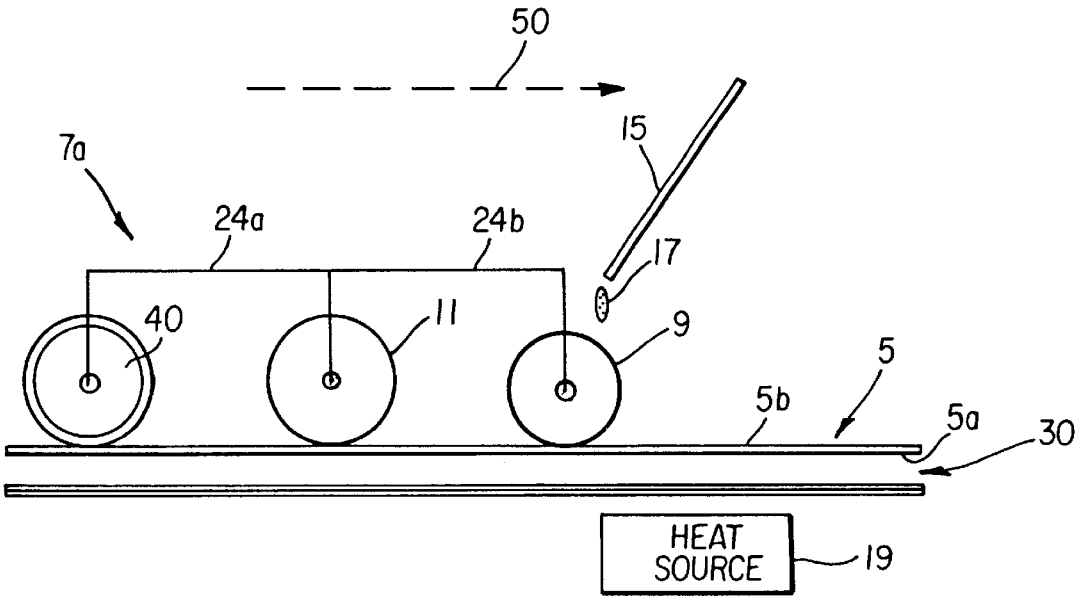
FIG. 2 is a side view of a second embodiment of the apparatus of the present invention including a spreader member, a pressure roller and a mixer member.

FIG. 2 illustrates a second embodiment of the apparatus of the present invention. Those elements in FIG. 2 which correspond to the elements in FIG. 1 utilize the same reference numeral. As illustrated in FIG. 2, roller arrangement 7*a* includes spreader member 9, solution delivery assembly 15 and pressure roller 11 as described in FIG. 1. Additionally, in the embodiment of FIG. 2, frame 24 is expanded and include sections 24*a*, 24*b*. Section 24*b* defines a mechanical connection and a fixed distance relationship between pressure roller 11 and spreader member 9 in the same manner as FIG. 1, while section 24*a* defines a mechanical connection and fixed distance relationship between a mixer member 40 and pressure roller 11. Therefore, in the embodiment of FIG. 2, an additional roller in the form of mixer member 40 is mechanically connected to pressure member 11 and spreader member 9.

With the arrangement of FIG. 2, it is only necessary to make one pass in direction 50 over photographic material 5. That is, during use of the apparatus of FIG. 2, roller arrangement 7*a* is passed over photographic material 5 in direction 50, or as an alternative, photographic material 5 can be conveyed under a fixed roller arrangement 7*a* in a direction opposite to direction 50. In the embodiment of FIG. 2, and using the conveyance of roller arrangement 7*a* over photographic material 5 as an example, as roller arrangement 7*a* is conveyed over photographic material 5 in direction 50, developer solution 17 is applied via solution delivery assembly 15 onto a surface of spreader member 9. Spreader member 9 applies solution 17 onto surface 5*b* of photographic material 5. Pressure roller 11 which follows spreader member 9 serves to press the applied solution onto photographic material 5, and mixer member 40 which can be a wire bar member and follows pressure member 11, serves to agitate the applied solution to enhance development.

Therefore, in the embodiment of FIG. 2, the applied solution would be treated as illustrated in FIGS. 3(*a*)–3(*c*). FIG. 3(*a*) corresponds to the application of solution via spreader member 9, FIG. 3(*b*) relates to the pressing of the solution onto the surface of photographic material 5 via pressure member 11, while FIG. 3(*c*) represents the agitation of the applied develop solution by way of mixer member 40. With the embodiment of FIG. 2, only one pass of roller arrangement 7*a* over a photographic material, or conversely, a single conveyance of photographic material 5 under a fixed roller arrangement 7*a* would be necessary. Additionally, as a further option, further mixer members 40, pressure rollers 11 and/or spreader members 9 can be added and/or provided in series. With an arrangement that includes additional mixer members, roller members and/or pressure members, exposed film can be conveyed pass a series of wire-wrapped applicator bars (spreader members) and squeegees (pressure rollers) with various solutions being applied sequentially at the different bars which could represent one configuration of an apparently dry processor. Additional wire-wrapped bars can be installed to promote agitation of the film surface. As an example, it is noted that a single stage apparatus as illustrated in FIG. 2 can be configured to sequentially apply distinct photographic processing solutions, or multiple stage apparatuses which include multiple roller arrangements such as those illustrated in FIGS. 1 and 2 could be configured to apply distinct photographic processing solutions at distinct solution application stations. These distinct photoprocessing solutions include but are not limited to solutions having: developing, fixing, bleaching, blixing, clearing, developing-fixing, stabilizing, toning and washing activity. While any known photo processing solution can be applied, specific useful solutions are described in the references cited earlier.

In the embodiment of FIG. 2 like FIG. 1, heat source 19 can be positioned under a bottom or non-emulsion side 5*a* of photographic material 5 to enhance development, and further, an intermediate layer of solution 30 which can be the same or different from solution 17 can be applied between support 100 having heat source 19 and surface 5*a* of photographic material 5. This serves to promote homogeneous transfer of heat to photographic material 5 by eliminating any air gaps which may occur between support 100 and photographic material 5.

Thus, the present invention provides for a method and apparatus that promotes a homogeneous spreading of solution such as developer solution and homogeneous development. With the arrangement of the present invention, it is possible to add developer solution to, for example, a wire-wrapped spreader bar by way of, for example, a solution delivery tube. This developer solution would be applied to, for example, the top of the bar using a pump such as a peristaltic pump.

Additionally, a pressure member in the form of, for example, a weighted or spring-loaded roller can follow the wire-wrapped spreader bar. The pressure roller acts as a squeegee roller in that it assures good contact of the roller with the photographic material, and further aids in pressing the photographic material against a heating plate.

Additionally, the passing of the wire-wrapped spreader bar over the film surface twice with developer being applied during the first pass only permits the spreader bar to act as an agitator during the second pass.

Also, a pre-wetting of the film back side promotes good thermal contact between the film and the heating plate. Additionally, the pre-wetting of the film emulsion side aids in spreading of the applied solution.

In a further feature of the present invention, it is noted that the width of the spreader members can be approximately equal to the width of the film so as to prevent any excess solution from running off of the heater plate. As a further option, the film can be placed in a trough and used with shortened spreader members to also prevent excess solution from running off the edges of the film.

The invention has been described in detail with particular reference to certain preferred embodiments thereof, but it will be understood that variations and modifications can be effected within the spirit and scope of the invention.

What is claimed is:

1. An apparatus for processing photographic material, the apparatus comprising:

a spreader member adapted to apply a solution onto a photographic material and control a thickness of the applied solution; and a pressure roller operationally connected to and spaced from said spreader member to contact and press down on the applied solution so as to provide for a substantially homogeneous layer of the applied solution on the photographic material.

2. An apparatus according to claim 1, further comprising a solution delivery assembly adapted to deliver the solution onto at least a surface of the spreader member for application onto the photographic material.

3. An apparatus according to claim 1, wherein said spreader member is a wire-wrapped spreader bar.

4. An apparatus according to claim 1, wherein said solution is a developing solution and said photographic material is exposed photosensitive film.

5. An apparatus according to claim 1, further comprising a heating source for heating the photographic material having the applied solution thereon.

6. An apparatus according to claim 5, wherein said pressure roller presses the photographic material against the heating source.

7. An apparatus according to claim 5, further comprising an intermediate layer of solution between a surface of the photographic material which is opposite the surface having the applied solution thereon and the heating source to promote homogeneous transfer of heat to the photographic material, said intermediate layer of solution being the same or different from said applied solution.

8. An apparatus according to claim 2, wherein said pressure roller is mechanically connected to the spreader member and is a fixed distance from said spreader member, said pressure roller following said spreader member as said spreader member applies solution onto the photographic material during a first pass of said spreader member and said pressure roller over said photographic material.

9. An apparatus according to claim 8, wherein during a second pass of said spreader member and said pressure roller over said photographic material which is in a direction opposite to a direction of the first pass, said spreader member follows said pressure roller and the delivery of solution onto the surface of the spreader member is stopped, such that during the second pass, said spreader member agitates the applied solution on the surface of the photographic material.

10. An apparatus according to claim 1, further comprising a mixer member operationally associated with said spreader member and said pressure roller.

11. An apparatus according to claim 10, wherein said pressure roller is located between said spreader member and said mixer member.

12. An apparatus according to claim 11, wherein during a single solution application pass over the photographic material by said spreader member, said pressure roller and said mixer member, said spreader member applies the solution onto the photographic material, said pressure roller which follows said spreader member presses the applied solution onto the photographic material, and said mixer member which follows said pressure roller agitates the applied solution.

13. An apparatus according to claim 10, wherein said mixer member is a wire-bar mixer and is spaced from said pressure roller at a fixed distance.

14. An apparatus according to claim 1, wherein said pressure roller is a weighted roller.

15. An apparatus according to claim 1, wherein said pressure roller is a spring-loaded roller.

16. A method of processing photographic material, the method comprising the steps of:

(a) delivering a solution onto a surface of a spreader member;

(b) applying the delivered solution through the spreader member onto a surface of a photographic material;

(c) controlling a thickness of the applied solution on the photographic material by use of the spreader member; and (d) pressing the applied solution on the photographic material by use of a pressing member in contact with the solution, so as to provide for a substantially homogeneous layer of the solution on the photographic material.

17. A method according to claim 16, wherein said steps (a)–(d) are performed during a first application pass of said spreader member and said pressing member over the photographic material.

18. A method according to claim 17, comprising the further steps of:

stopping the delivery of solution onto the spreader member at an end of the first application pass; and agitating the applied layer of solution by use of said spreader member during a second application pass of the spreader member and the pressing member over the photographic material which is opposite to a direction of the first application pass.

19. A method according to claim 16, wherein said spreader member is a wire wrapped roller.

20. A method according to claim 16, wherein said solution is a developing solution and said photographic material is exposed photosensitive film.

21. A method according to claim 16, comprising the further step of:

heating said photographic material through a heating source during at least said steps (a) to (d).

22. A method according to claim 21, comprising the further step of:

providing an intermediate solution layer between said heating source and a surface of the photographic material which is opposite to the surface having the solution applied thereon to promote homogeneous heating of said photographic material, said intermediate solution layer being the same or different from said applied solution.

23. A method according to claim 16, comprising the further step of:

agitating the applied solution layer after said step (d) by use of a mixer member;

wherein said steps (a) to (e) occur during a single application pass of said spreader member, pressing member and mixer member over the photographic material.

24. A method according to claim 23, wherein said mixer member is a wire-bar roller.

25. A method according to claim 16, wherein said pressing member is a weighted roller.

26. A method according to claim 16, wherein said pressing member is a spring-loaded roller.

27. A method according to claim 16, wherein said spreader member and said pressing member are mechanically connected to each other and are positioned a fixed distance from each other.

28. A method according to claim 23, wherein said spreader member, said pressing member and said mixer member are mechanically connected to each other, with said pressing member being located between said spreader member and said mixer member.

29. An apparatus for processing photographic material, the apparatus comprising:

a spreader member adapted to apply a solution onto a photographic material and control a thickness of the applied solution; and a mixer member operationally associated with said spreader member and adapted to contact the solution.

30. An apparatus according to claim 29, wherein during a single solution application pass over the photographic material by said spreader member and said mixer member, said spreader member applies solution onto the photographic material and said mixer member which follows said spreader member agitates the applied solution.

31. A method of processing photographic material, the method comprising the steps of:

(a) delivering a solution onto a surface of a spreader member;

(b) applying the delivered solution through the spreader member onto a surface of a photographic material;

(c) controlling a thickness of the applied solution on the photographic material by use of the spreader member; and (d) agitating the applied solution by use of a mixer member in contact with the solution.

* * * * *